US007862034B2

(12) United States Patent
Kobayashi

(10) Patent No.: US 7,862,034 B2
(45) Date of Patent: Jan. 4, 2011

(54) PAPER FEEDING DEVICE AND IMAGE FORMING APPARATUS

(75) Inventor: Yusuke Kobayashi, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 264 days.

(21) Appl. No.: 11/208,737

(22) Filed: Aug. 23, 2005

(65) Prior Publication Data

US 2006/0202406 A1 Sep. 14, 2006

(30) Foreign Application Priority Data

Mar. 9, 2005 (JP) ..... P.2005-065783

(51) Int. Cl.
*B65H 1/00* (2006.01)

(52) U.S. Cl. ..... 271/145; 271/162

(58) Field of Classification Search ..... 271/145, 271/147, 162–164
See application file for complete search history.

(56) References Cited

U.S. PATENT DOCUMENTS

| | | | | |
|---|---|---|---|---|
| 4,540,169 | A | 9/1985 | Levinson | |
| 4,861,017 | A * | 8/1989 | Yamamoto et al. | 271/258.03 |
| 4,998,714 | A * | 3/1991 | Sparer et al. | 271/117 |
| 5,013,025 | A * | 5/1991 | Arai et al. | 271/164 |
| 5,419,544 | A * | 5/1995 | Ono et al. | 271/164 |
| 7,277,199 | B2 * | 10/2007 | Swayze et al. | 358/1.9 |
| 2002/0036377 | A1 * | 3/2002 | Togashi | 271/127 |
| 2004/0041334 | A1 * | 3/2004 | Yoshihara | 271/145 |
| 2004/0188922 | A1 * | 9/2004 | Takahashi et al. | 271/145 |

FOREIGN PATENT DOCUMENTS

| | | | |
|---|---|---|---|
| CN | 1534394 | A | 10/2004 |
| JP | 54-020923 | A | 2/1979 |
| JP | 54-020924 | A | 2/1979 |
| JP | 5-735 | A | 1/1993 |
| JP | 7-441 | Y2 | 1/1995 |
| JP | 10-120201 | A | 5/1998 |
| JP | 10-120202 | A | 5/1998 |
| JP | 11-020961 | A | 1/1999 |
| JP | 2001-301993 | A | 10/2001 |
| JP | 2001-314252 | A | 11/2001 |
| JP | 2002-173232 | A | 6/2002 |

OTHER PUBLICATIONS

Japanese Office Action dated Oct. 20, 2009 in Application No. 2005-065783.

* cited by examiner

*Primary Examiner*—Stefanos Karmis
*Assistant Examiner*—Prasad V Gokhale
(74) *Attorney, Agent, or Firm*—Sughrue Mion, PLLC

(57) ABSTRACT

A paper feeding device including: a paper feeding device body; a paper feeding cassette which is contained in the paper feeding device body so as to be freely drawn out; a guide part for guiding the paper feeding cassette with respect to the paper feeding device body along a substantially rectilinear line; a stopper for locking the paper feeding cassette on the way of drawing out the paper feeding cassette from the paper feeding device body; and a stopper releasing part which is integrally formed with the guide part and adapted to be flexed according to operation of drawing out the paper feeding cassette, thereby to release the lock of the stopper.

16 Claims, 7 Drawing Sheets

ON OCCASION OF INSERTING
ON OCCASION OF DRAWING OUT
56
82
58
22
84
98
90
SEE DETAILED VIEW A
SEE DETAILED VIEW B
SEE DETAILED VIEW C
SEE DETAILED VIEW D
SEE DETAILED VIEW E
SEE DETAILED VIEW F

PAPER FEEDING DEVICE AND IMAGE FORMING APPARATUS

BACKGROUND OF THE INVENTION

1. Field of the Invention

The present invention relates to a paper feeding device and an image forming apparatus provided with the same.

2. Background Art

In an image forming apparatus, there is employed a paper feeding device for feeding paper on which an image is to be formed. The paper feeding device of this type has a paper feeding cassette which is contained in a paper feeding device body so as to be freely drawn out, and the paper can be replenished, by drawing out the paper feeding cassette from the paper feeding device body.

In case where the paper feeding cassette is drawn out with no resistance, it is concerned that the paper feeding cassette may jump out violently, and a backward end of the paper feeding cassette may fall on a foot of a user. For preventing such phenomenon, there has been known a paper feeding device in which the paper feeding cassette is once locked, as a safety net on occasion of drawing out the paper feeding cassette, and thereafter, the lock is released for enabling the paper feeding cassette to be drawn out.

For example, JP-A-5-735 and JP-UM-B-7-441 disclose paper feeding devices in which stoppers are provided on upper sides of guide rails, and the paper feeding cassette can be drawn out after once locked, by inclining the paper feeding cassette upwardly. JP-A-2002-173232 discloses a paper feeding device in which stoppers are provided on the paper feeding device body so as to be opposed to the paper feeding cassette at both sides of the paper feeding cassette.

However, in the paper feeding device of the type as disclosed in JP-A-5-735 and JP-UM-B-7-441, the paper feeding cassette is once locked, and thereafter, inclined upwardly so that the paper feeding cassette can be drawn out. Therefore, extra actions besides ordinary actions, such as inclining the paper feeding cassette, lifting it, and inclining it again, after once returned, have been required. Moreover, operation of inserting the paper feeding cassette into the paper feeding device body has also required a large action to the same extent as the operation of drawing it out. For example, the paper feeding cassette must be inclined without straightly inserting, and operability has been poor. In the paper feeding device of the type as disclosed in JP-A-2002-173232, because the stoppers are provided on the paper feeding device body so as to be opposed to the paper feeding cassette at both sides thereof, springs or the like are necessary for actuating and releasing the stoppers. Therefore, there has been a problem that the number of components has increased.

SUMMARY OF THE INVENTION

It is an object of the invention to provide a paper feeding device in which operability for drawing out or inserting a paper feeding cassette can be enhanced, without increasing components in number, and an image forming apparatus provided with the same.

A first aspect of the invention lies in a paper feeding device characterized by comprising a paper feeding device body, a paper feeding cassette which is contained in the paper feeding device body so as to be freely drawn out, a guide part for guiding the paper feeding cassette with respect to the paper feeding device body along a substantially rectilinear line, a stopper for locking the paper feeding cassette on the way of drawing out the paper feeding cassette from the paper feeding device body, and a stopper releasing part which is integrally formed with the guide part and adapted to be flexed according to operation of drawing out the paper feeding cassette, thereby to release the lock of the stopper. Accordingly, in case of drawing out or inserting the paper feeding cassette from or into the paper feeding device body, it is possible to guide the paper feeding cassette along the substantially rectilinear line by means of the guide part, and hence, operability can be enhanced. Moreover, in case of drawing out the paper feeding cassette, this can be realized by flexing the stopper releasing part which is integrally formed with the guide part, and hence, the number of components will not be increased.

Preferably, the stopper is formed in the paper feeding cassette, and includes an insertion part which is gradually tapered in a direction of inserting the paper feeding cassette and a butting face directed in a direction of drawing out the paper feeding cassette, the butting face being so adapted as to be locked to a stopper receptor which is formed in the paper feeding device body, when the paper feeding cassette is drawn out. Accordingly, when the paper feeding cassette is drawn out, the butting face will be butted against the stopper receptor on the paper feeding device body, thus enabling the paper feeding cassette to be reliably stopped. On the other hand, when the paper feeding cassette is inserted, it is possible to smoothly insert the paper feeding cassette in the natural inserting direction (along the rectilinear line) by means of the insertion part which is gradually tapered, without making such extra action as inclining the paper feeding cassette.

Moreover, the stopper releasing part is preferably formed in a thin-walled shape. Accordingly, when the paper feeding cassette is drawn out, the stopper releasing part in a thin-walled shape which is integrally formed with the guide part will be flexed thereby to release the lock of the stopper. Therefore, by adjusting wall thickness and width of this stopper releasing part in a thin-walled shape, appropriate operability can be obtained.

Further, the paper feeding cassette preferably includes a first member which is arranged at a forward side in the drawing out direction, and a second member which is arranged at a backward side in the drawing out direction and slidably connected to the first member, wherein the first member is protruded from the paper feeding device body, and the second member is contained inside the paper feeding device body, in a state where the paper feeding cassette is extended and locked by means of the stopper. Accordingly, it is possible to extend or contract the paper feeding cassette by sliding the second member with respect to the first member. Because the first member is protruded from the paper feeding device body, and the second member is contained inside the paper feeding device body, in a state where the paper feeding cassette is extended and locked by means of the stopper, it is possible to obtain a large overlapping amount of the paper feeding cassette with respect to the paper feeding device body, and to secure stability of the paper feeding cassette, when the paper feeding cassette is stopped. For example, such an accident that the paper feeding cassette may be broken by an external force can be prevented.

Still further, the paper feeding cassette preferably includes a first member which is arranged at a forward side in the drawing out direction, and a second member which is arranged at a backward side in the drawing out direction and slidably connected to the first member, the stopper being provided on the second member, and opposed to the paper feeding device body irrespective of whether the paper feeding cassette is extended or contracted. Accordingly, because the stopper provided on the second member is opposed to the paper feeding device body irrespective of whether the paper feeding cassette is extended or contracted, it is possible to stop the paper feeding cassette by the stopper, even though the paper feeding cassette is extended or contracted.

Still further, the stopper releasing part is preferably provided in a backward area beyond an insertion inlet for the paper feeding cassette, which is provided in the paper feeding device body. Accordingly, the paper feeding cassette is locked in a state where it has been inserted deep beyond the insertion inlet of the paper feeding device body, and movement of the paper feeding cassette in a direction perpendicular to the inserting direction will be restrained by the guide part and so on. Therefore, it is possible to draw out the paper feeding cassette smoothly in the natural drawing out direction (along the rectilinear line), without making such extra action as inclining the paper feeding cassette. Moreover, constrained force will not be applied in the direction perpendicular to the inserting direction of the paper feeding cassette, and breakdown of the interior of the paper feeding device body including the stopper, guide part, stopper releasing part and so on can be prevented.

A second aspect of the invention lies in a paper feeding device characterized by comprising a paper feeding device body, and a paper feeding cassette which is contained in the paper feeding device body so as to be freely drawn out, the paper feeding cassette including a first member which is arranged at a forward side in a direction of drawing out the paper feeding cassette, and a second member which is arranged at a backward side in the drawing out direction and slidably connected to the first member, the paper feeding device further comprising a stopper for locking the paper feeding cassette on the way of drawing out the paper feeding cassette from the paper feeding device body, wherein the first member is protruded from the paper feeding device body, and the second member is contained inside the paper feeding device body, in a state where the paper feeding cassette is extended and locked by means of the stopper. Accordingly, it is possible to extend or contract the paper feeding cassette by sliding the second member with respect to the first member. Because the first member is protruded from the paper feeding device body, and the second member is contained inside the paper feeding device body, in a state where the paper feeding cassette is extended and locked by means of the stopper, it is possible to obtain a large overlapping amount of the paper feeding cassette with respect to the paper feeding device body, and to secure stability of the paper feeding cassette, when the paper feeding cassette is stopped. For example, such an accident that the paper feeding cassette may be broken by an external force can be prevented.

A third aspect of the invention lies in a paper feeding device characterized by comprising a paper feeding device body, a paper feeding cassette which is contained in the paper feeding device body so as to be freely drawn out, the paper feeding cassette including a first member which is arranged at a forward side in a direction of drawing out the paper feeding cassette, and a second member which is arranged at a backward side in the drawing out direction and slidably connected to the first member, the second member being provided with a stopper for locking the paper feeding cassette on the way of drawing out the paper feeding cassette from the paper feeding device body, the stopper being opposed to the paper feeding device body irrespective of whether the paper feeding cassette is extended or contracted. Accordingly, because the stopper provided on the second member is opposed to the paper feeding device body irrespective of whether the paper feeding cassette is extended or contracted, it is possible to stop the paper feeding cassette by the stopper, even though the paper feeding cassette is extended or contracted.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
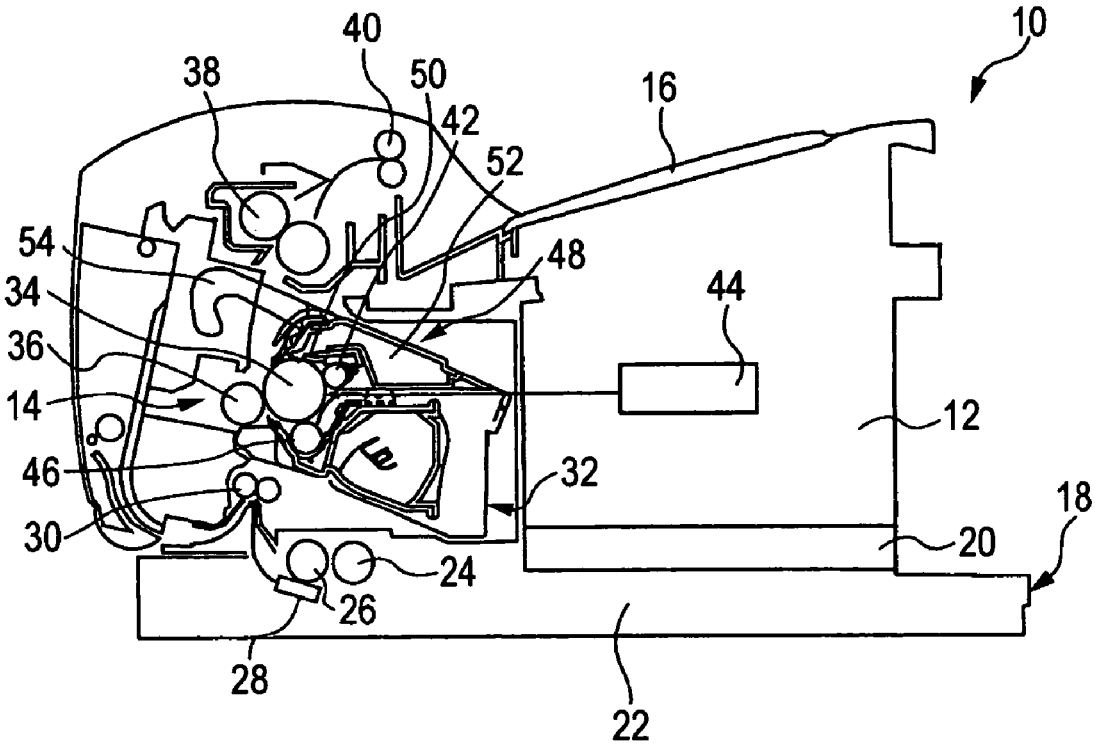
FIG. 1 is a side view showing an image forming apparatus according to an embodiment of the invention.
Figure 2:
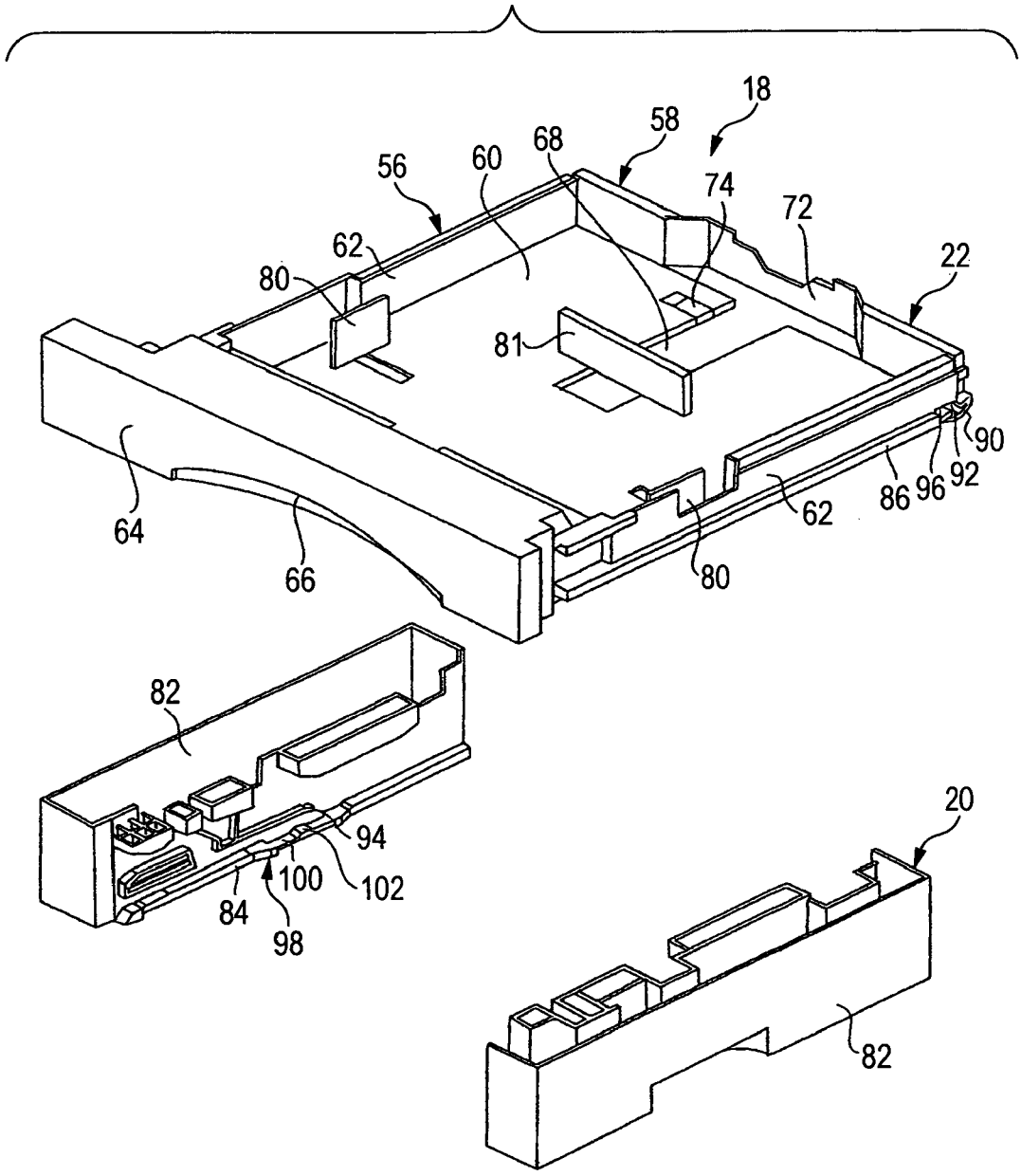
FIG. 2 is an exploded perspective view of a paper feeding device according to the embodiment of the invention, in a state where a paper feeding cassette is contracted.

Now, an embodiment of the invention will be described referring to the drawings.

FIG. 1 schematically shows an image forming apparatus 10 according to the embodiment of the invention. The image forming apparatus 10 includes an image forming apparatus body 12. Image forming means 14 is mounted inside the image forming apparatus body 12, and a discharge part 16 is provided in an upper part of the image forming apparatus body 12. At the same time, a paper feeding device 18 of one step, for example, is provided in a lower part of this image forming apparatus body 12.

The paper feeding device 18 includes a paper feeding device body 20, and a paper feeding cassette 22 in which sheets of paper are contained. The paper feeding cassette 22 is provided in the paper feeding device body 20 so as to be freely drawn out. Paper feeding rolls 24, 26 are arranged on the paper feeding device body 20, and the sheets of paper stacked on the paper feeding cassette 22 will be transferred to a register roll 30 with rotation of these paper feeding rolls 24, 26. The paper feeding roll 26 arranged at a downstream side is in contact with a separating pad 28 provided on the paper feeding cassette 22 and adapted to separate the sheets which have been fed out from the paper feeding roll 24, in cooperation with the separating pad 28.

At a downstream side from the register roll 30, there are provided an image carrier 34 and a transferring device 36 of a process cartridge 32 which will be described below, and at a further downstream side, there is arranged a fixing device 38.

Therefore, the sheets which have been fed out from the paper feeding cassette 22 of the paper feeding device 18 by means of the paper feeding rolls 24, 26 will be temporarily stopped by the register roll 30, and then, will be passed at an appropriate timing through a path between the image carrier 34 and the transferring device 36, where an image of developing agent will be transferred. This image of the developing agent which has been transferred will be fixed by the fixing device 38, and the sheets will be discharged to the discharge part 16 by means of a discharging roll 40.

The image forming means 14 is of electro-photographic type, and includes the image carrier 34 formed of photosensitive body, an electrifying device 42 including, for example, an electrifying roll for uniformly electrifying the image carrier 34, an optical writing device 44 for writing with light a latent image on the image carrier 34 which has been electrified by the electrifying device 42, a developing device 46 for visualizing with developing agent the latent image which has been formed on the image carrier 34 by the optical writing device 44, the transferring device 36 including, for example, a transfer roll for transferring the image of the developing agent formed by the developing device 46 onto the sheet, a cleaning device 48 for cleaning the developing agent remaining on the image carrier 34, and the fixing device 38 including, for example, a pressurizing roll and a heating roll and adapted to fix the image of the developing agent on the sheet of paper which has been transferred by the transferring device 36. The optical writing device 44 includes, for example, a laser exposing device of scanning type, which forms the latent image on the image carrier 34, passing through the process cartridge 32, which will be described below. The cleaning device 48 has a cleaning blade 50 in contact with the image carrier 34, and a developing agent recovery part 52 for receiving the developing agent which has been rubbed off with the cleaning blade 50.

It is to be noted that an LED or a surface light emitting laser may be used as other embodiments of the optical writing device 44.

The process cartridge 32 is a unit integrally containing the image carrier 34, the electrifying device 42, the developing device 46 and the cleaning device 48. These devices can be exchanged as the integral unit. The process cartridge 32 is provided with a handle 54 which extends diagonally upwardly (diagonally upwardly to the left in FIG. 1) from the cleaning device 48 and has a downwardly curved tip end. Accordingly, when the process cartridge 32 is exchanged, the process cartridge 32 can be easily withdrawn from the image forming apparatus body 12, by gripping the handle 54.

Figure 5:
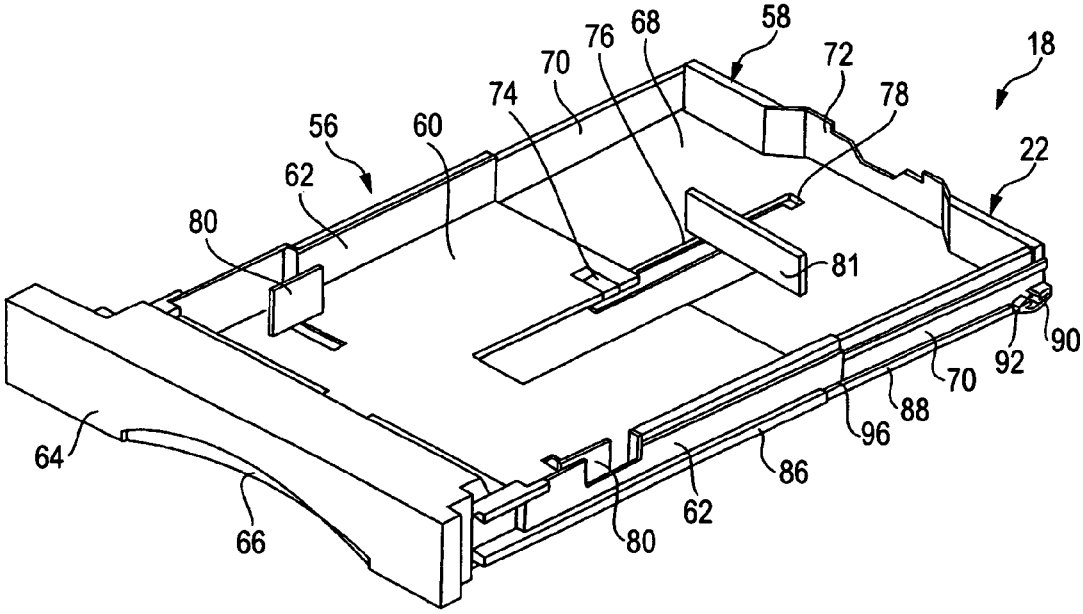
FIG. 5 is a perspective view of the paper feeding cassette of the paper feeding device according to the embodiment of the invention, in a state where the paper feeding cassette is extended.
Figure 6:
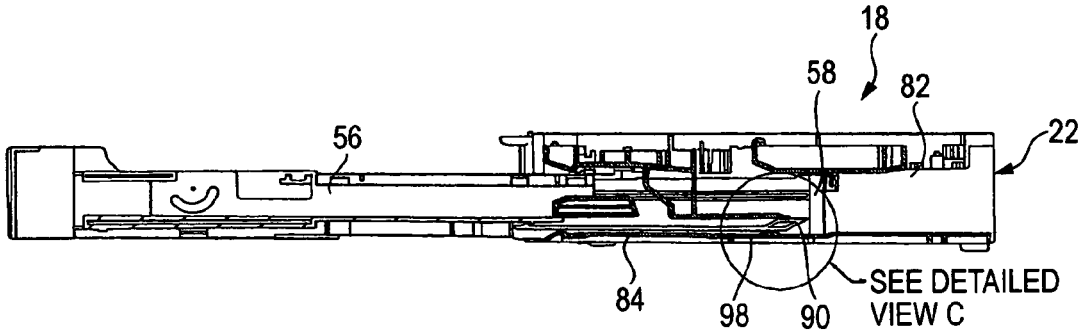
FIG. 6 is a sectional side view of the paper feeding device according to the embodiment of the invention, in a state where the paper feeding cassette is extended.

Particulars of the paper feeding device 18 are shown in FIGS. 2 to 8F. The paper feeding cassette 22 is formed by combining a first member 56 and a second member 58. The first member 56 has a bottom part 60, side parts 62, 62 projecting upright from both ends of the bottom part 60, and a front part 64 projecting upright from a front end of the bottom part 60. The front part 64 of the first member 56 is provided with a pull-out operation part 66 for drawing out the paper feeding cassette 22, in a lower front part thereof. On the other hand, the second member 58 has a bottom part 68, side parts 70, 70 projecting upright from both ends of the bottom part 68, and a back part 72 projecting upright from a backward end of the bottom part 68. The side parts 70, 70 of the second member 58 are slidably inserted inward of the side parts 62, 62 of the first member 56, so that the paper feeding cassette 22 can be extended or contracted by sliding the first member 56 and the second member 58 with respect to each other. In addition to the side parts, the bottom part 68 of the second member 58 may be also inserted into the bottom part 60 of the first member 56. In a contracted state where the second member 58 has been pushed most deeply into the first member 56 (as shown in FIGS. 2 and 7A to 7F), an inner size of the paper feeding cassette 22 corresponds to A4 size for example, and in an extended state where the second member 58 has been drawn out from the first member 56 most outwardly (as shown in FIGS. 5 and 6), the inner size of the paper feeding cassette 22 corresponds to A3 size, for example. In this manner, by extending or contracting the paper feeding cassette 22, the sheets having different sizes can be contained.

A lock member 74 is provided on the bottom part 60 of the first member 56 so as to slide in a lateral direction. At the same time, a slide groove 76 is formed in a longitudinal direction in the bottom part 68 of the second member 58, so that the lock member 74 can slide through the slide groove 76. The slide groove 76 is formed with lock notches 78 in a lateral direction at appropriate positions, for example, both front and rear ends of the slide groove 76. When the lock member 74 is engaged with either of these lock notches 78, the first member 56 and the second member 58 will be locked in the extended state or in the contracted state.

Side guides 80, 80 are slidably provided in the bottom part 60 of the first member 56. The paper to be stored can be guided, by sliding these side guides 80, 80 according to the paper to be stored in a widthwise direction of the paper.

The paper feeding device body 20 has support parts 82, 82 which are separately arranged at an interval corresponding to a width of the paper feeding cassette 22. The support parts 82, 82 are respectively formed with guide parts 84, 84, in inward lower parts thereof, which extend from a forward end of the paper feeding device body 20 to a backward end along substantially straight lines. On the other hand, the first member 56 of the paper feeding cassette 20 is formed with first rails 86, 86 in lower parts at both sides along substantially straight lines, and the second member 58 is formed with second rails 88, 88 corresponding to the first rails 86, 86. In the contracted state of the paper feeding cassette 22, the first rails 86, 86 slide along the guide parts 84, 84 of the paper feeding device body 20, and in the extended state of the paper feeding cassette 22, both the first rails 86, 86 and the second rails 88, 88 slide along the guide parts 84, 84. In this manner, the paper feeding cassette 22 is held in the paper feeding device body 20 so as to be freely drawn out.

Further, the second member 58 of the paper feeding cassette 22 is formed with stoppers 90, 90 in the backward ends thereof continued from the second rails 88, 88. Each of these stoppers 90, 90 has a shape of parallelogram in a side view of the paper feeding cassette 22, and is so formed as to be gradually tapered toward a tip end thereof. As shown in detail in FIG. 4, the stopper 90 is cut away in an upper front part to form a butting face 92 which is directed forward of the paper feeding cassette 22. The paper feeding device body 20 is formed with stopper receptors 94, 94 which are directed backward, corresponding to the butting faces 92, 92 of the stoppers 90, 90, in a substantially center part. When the paper feeding cassette 22 is drawn out from the paper feeding device body 20, the stoppers 90, 90 will be locked to the stopper receptors 94, 94 thereby to stop the paper feeding cassette 22. In this embodiment, cut outs 96, 96 are formed in the backward end of the first member 56 of the paper feeding cassette, in correspondence with the stoppers 90, 90. In the contracted state of the paper feeding cassette 22, the stoppers 90, 90 are protruded through the cut outs 96, 96 to the right and left of the paper feeding cassette 22, so that they are opposed to the paper feeding device body 20 irrespective of whether the paper feeding cassette 22 is extended or contracted, thereby ensuring the stop of the paper feeding cassette 22.

The above described stopper receptors 94, 94 are disposed in the center part of the paper feeding device body 20 (at a position in the center part in case where the paper feeding device body 20 is equidistantly divided in three in a longitudinal direction), and accordingly, when the paper feeding cassette 22 is drawn out, it is possible to stop the paper feeding cassette 22 while a larger part thereof is remained inside the paper feeding device body 20. In this embodiment, even in the extended state of the paper feeding cassette 22, the second member 58 is contained inside the paper feeding device body 20, although almost all parts of the first member 56 are protruded from the paper feeding device body 20. The second member 58 which is slidably inserted into the first member 56 must have lower rigidity as compared with the first member 56. However, because the second member 58 is contained inside the paper feeding device body 20 in a state where the paper feeding cassette 22 is stopped, an external force can be received by the first member 56 when the paper feeding cassette 22 receives the force from outside. In this manner, the second member 58 can be prevented from being affected by the external force, and therefore, it is possible to prevent the paper feeding cassette 22 from being deformed or broken.

Figure 3:
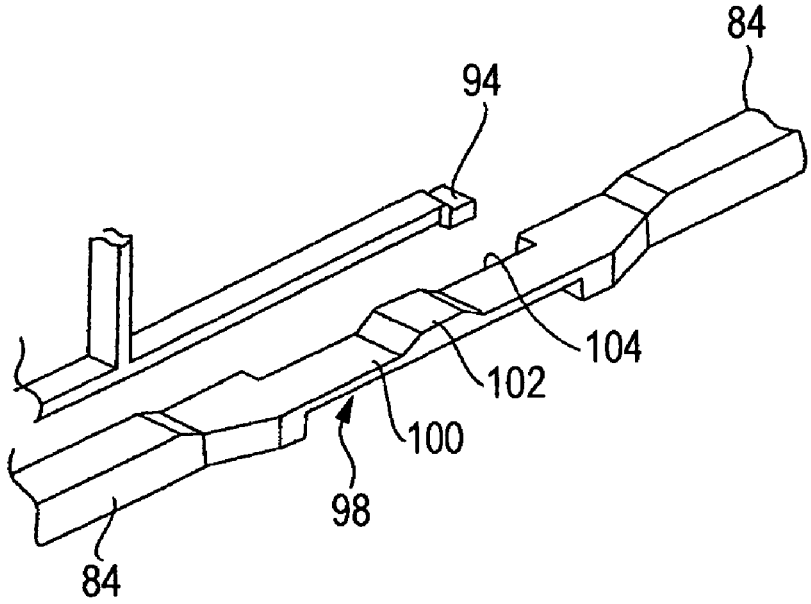
FIG. 3 is an enlarged perspective view showing a stopper releasing part and its vicinity which are formed in a paper feeding device body of the paper feeding device according to the embodiment of the invention.
Figure 4:
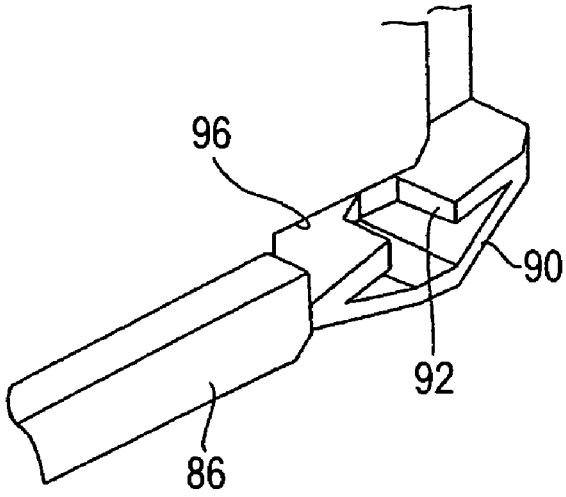
FIG. 4 is an enlarged perspective view showing a stopper and its vicinity which are formed in the paper feeding cassette of the paper feeding device according to the embodiment of the invention.

As shown in detail in FIG. 3, a stopper releasing part 98 is formed in a substantially center part of each of the guide parts 84, 84, integrally with the guide part 84. This stopper releasing part 98 has a thin-walled part 100 having a smaller wall thickness (the wall thickness in a vertical direction is smaller than in other areas) in a part of the guide part 84, and a projected part 102 which is projected upwardly from a center part of this thin-walled part 100. The thin-walled part 100 is formed with a cutout 104 opposed to the paper feeding device body 20, for allowing the thin-walled part to be flexed in a vertical direction. The projected part 102 is formed in a trapezoidal shape in a side view, in such a manner that a lower face of the stopper 90 can smoothly ride over the projected part 102. The above described stopper receptor 94 is formed near an upper part of the projected part 102, so that the butting face 92 of the stopper 90 can be locked to the stopper receptor 94 in a state where the stopper 90 has ridden on the projected part 102.

Then, referring to FIGS. 7A to 7F and 8A to 8F, operation for drawing out the paper feeding cassette 22 from the paper feeding body 20 will be described.

Figures 7A, 7B, 7C, 7D, 7E, 7F:
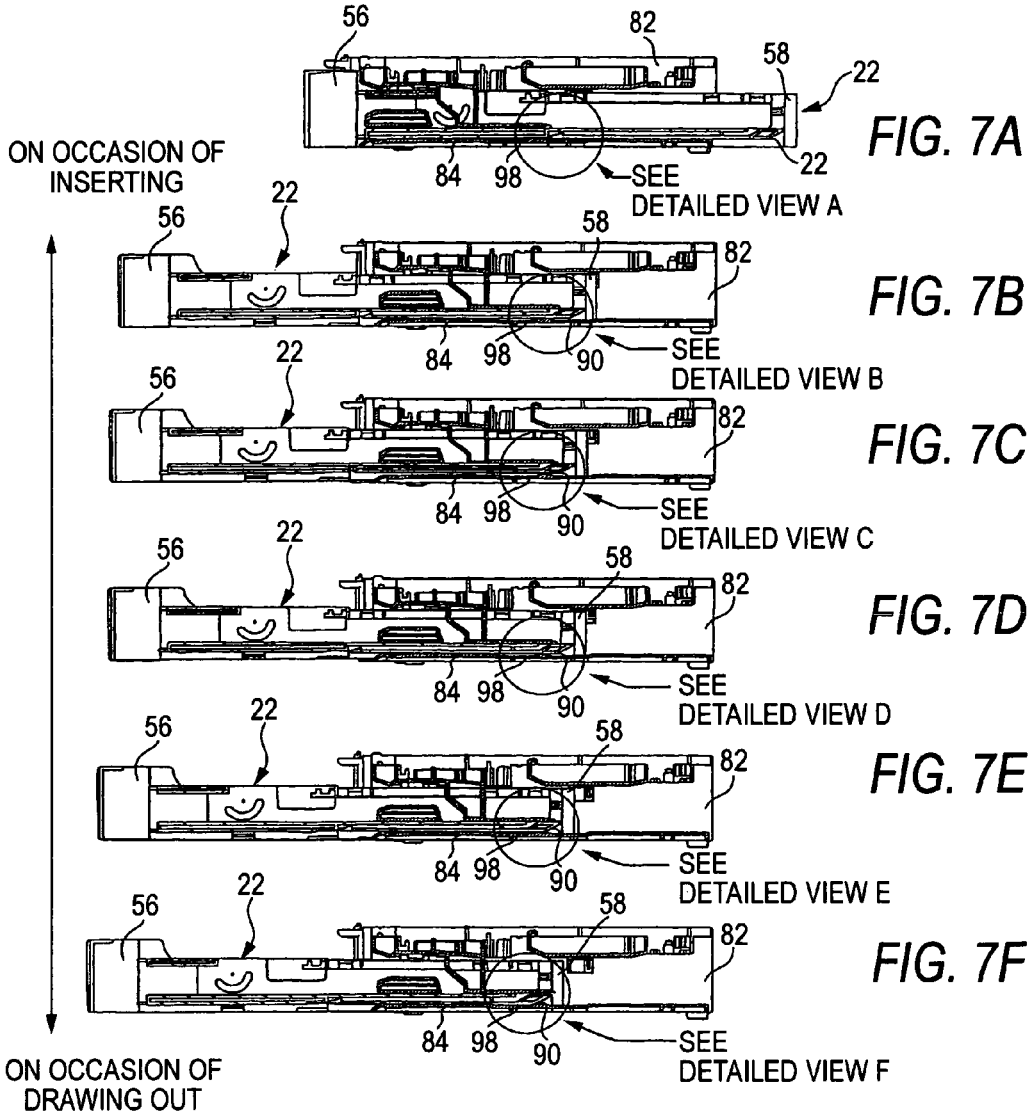
FIGS. 7A to 7F are sectional views of the paper feeding device according to the embodiment of the invention, showing a flow of operations for drawing out the paper feeding cassette from the paper feeding device body, from the state where the paper feeding cassette is contracted.
Figure 8A:
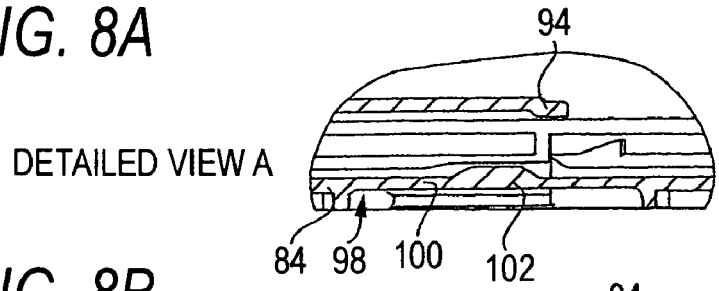
FIGS. 8A to 8F are sectional views of the paper feeding device according to the embodiment of the invention, showing an essential part thereof in respective states in FIGS. 7A to 7F.

As shown in FIGS. 7A and 8A, in a state where the paper feeding cassette 22 is mounted on the paper feeding device body 20, the first rails 86, 86 (and the second rails 88, 88) of the paper feeding cassette 22 are placed on the guide parts 84, 84 of the paper feeding device body 20, and an inner face of the front part 64 of the first member 56 is in contact with front faces of the support parts 82, 82 of the paper feeding device body 20, whereby the paper feeding cassette 22 is fixed to the paper feeding device body 20. In case where the sheets of paper are stored in the paper feeding cassette 22, the uppermost sheet will be brought into contact with the paper feeding roll 24 to be fed out. In this state, the backward end of the paper feeding cassette 22, together with the stoppers 90, 90, is projected to a back face side of the paper feeding device body 20.

Figure 8B:
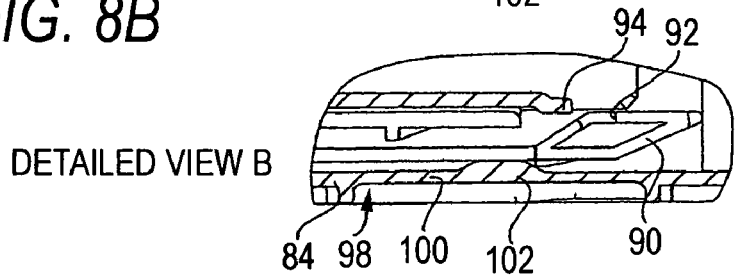

When the paper feeding cassette 22 is drawn out by handling the pull-out operation part 66, the stoppers 90, 90 of the paper feeding cassette 22 will come into contact with the projected parts 102, 102 of the stopper releasing parts 98, 98, as shown in FIGS. 7B and 8B, whereby the stoppers 90, 90 will be smoothly elevated.

Figure 8C:
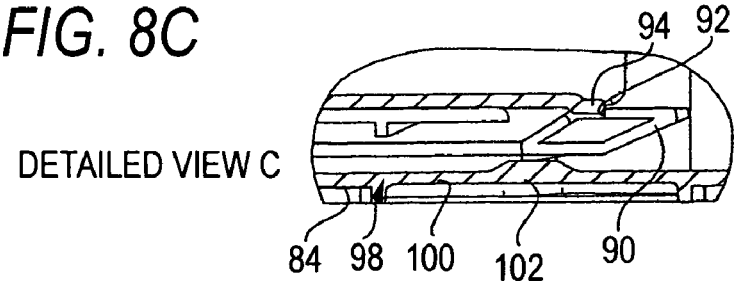

As the paper feeding cassette 22 is further drawn out, the stoppers 90, 90 will be further elevated, until the butting faces 92, 92 of the stoppers 90, 90 are butted against the stopper receptors 94, 94 of the paper feeding device body 20, as shown in FIGS. 7C and 8C, whereby the paper feeding cassette 22 will be stopped.

Figure 8D:
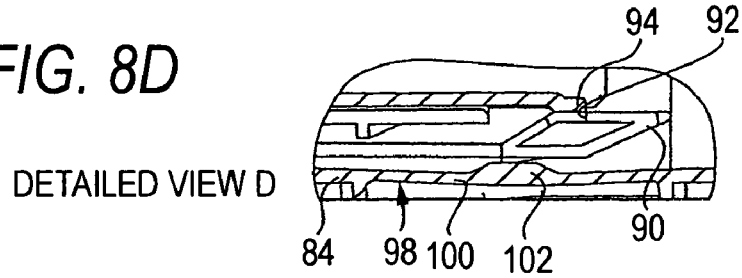
Figure 8E:
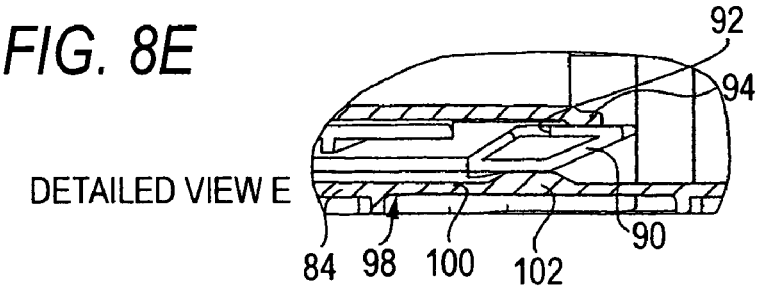
Figure 8F:
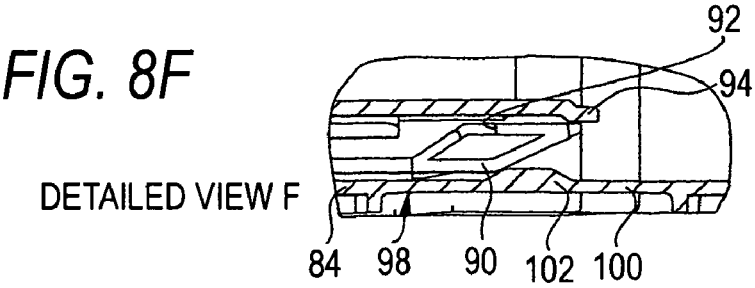

From this state, the paper feeding cassette 22 will be further drawn out with force. Then, as shown in FIGS. 7D and 8D, lower parts of the stoppers 90, 90 of the paper feeding cassette 22 will press the stopper releasing parts 98, 98 downward, by way of the projected parts 102, 102. Because the stopper releasing parts 98, 98 have the thin-walled parts 100, 100 which will be flexed downward by the pressure from the stoppers 90, 90, the engagement between the stoppers 90, 90 and the stopper receptors 94, 94 will be released.

When the paper feeding cassette 22 is further drawn out, the stoppers 90, 90 will smoothly run across the projected parts 102, 102 of the stopper releasing parts 98, 98, as shown in FIGS. 7E, 7F and 8E, 8F and continue to move while being guided by the guide parts 84, 84 of the paper feeding device body 20.

Accordingly, because the paper feeding cassette 22 is guided along a substantially rectilinear line, the paper feeding cassette 22 can be drawn out, without making factitious actions such as lifting the paper feeding cassette 22.

On the other hand, in order to insert the paper feeding cassette 22 into the paper feeding device body 20, operations in an inverse order to the above described operations, that is, in the order FIGS. 7F, 7E, 7D, 7C, 7B and 7A will be conducted. In this case, because the tip ends of the stoppers 90, 90 are gradually tapered, it is possible to pass the stoppers 90, 90 smoothly between the stopper receptors 94, 94 and the projected parts 102, 102, by inserting the paper feeding cassette 22 along the substantially rectilinear line.

Although the stoppers are provided on the paper feeding cassette, and the stopper receptors are provided on the paper feeding device body in the above described embodiment, another embodiment in which the stoppers are provided on the paper feeding device body and the stopper receptors are provided on the paper feeding cassette, to the contrary, may be also employed.

As described herein above, the invention can be applied to the paper feeding device in which the paper feeding cassette can be freely drawn out from the paper feeding device body.

What is claimed is:

1. A paper feeding device comprising:

a paper feeding device body;

a paper feeding cassette which is contained in the paper feeding device body so as to be freely drawn out;

a guide part for guiding the paper feeding cassette with respect to the paper feeding device body along a substantially rectilinear line;

a stopper for locking the paper feeding cassette when the paper feeding cassette is drawn out from the paper feeding device body;

a stopper releasing part which is integrally formed with the guide part and flexes when the paper feeding cassette is further drawn out and the stopper passes from a side of the stopper release part that is closer to a rear of the device body to a side of the stopper release part that is farther away from the rear of the device body, thereby releasing the stopper;

wherein the stopper is formed in the paper feeding cassette, and includes an insertion part which is gradually tapered in a direction of inserting the paper feeding cassette and a butting face directed in a direction of drawing out the paper feeding cassette, the butting face being so adapted as to be locked to a stopper receptor which is formed in the paper feeding device body, when the paper feeding cassette is drawn out;

wherein the paper feeding cassette includes a first member which is arranged at a forward side in a drawing out direction, and a second member which is arranged at a backward side in the drawing out direction and slidably connected to the first member; and the stopper is provided on the second member, and opposed to the paper feeding device body irrespective of whether the paper feeding cassette is extended or contracted.

2. The paper feeding device according to claim 1, wherein wherein the stopper releasing part is formed in a thin-walled shape.

3. The paper feeding device according to claim 1, wherein the stopper releasing part is provided in a backward area beyond an insertion inlet for the paper feeding cassette, which is provided in the paper feeding device body.

4. The paper feeding device according to claim 1, wherein the paper feeding cassette includes a first member which is arranged at a forward side in a drawing out direction, and a second member which is arranged at a backward side in the drawing out direction and slidably connected to the first member, wherein the first member is protruded from the paper feeding device body, and the second member is contained inside the paper feeding device body, in a state where the paper feeding cassette is extended and locked by means of the stopper.

5. The paper feeding device according to claim 1, wherein the stopper releasing part includes a projected part and thin-walled parts, the projected part projects from the releasing part at a position between the thin-walled parts, and the stopper locks the paper feeding cassette in a state where the stopper is ridden on the projected part.

6. The paper feeding device according to claim 5, wherein the projected part has a trapezoidal shape.

7. The paper feeding device according to claim 1, wherein the stopper is formed at a rear of the paper feeding cassette.

8. The paper feeding device according to claim 1, wherein the stopper has a shape of a parallelogram in side view, the gradually-tapered insertion part forming a side of the parallelogram.

9. The paper feeding device according to claim 1, wherein the butting face is formed from a cut away in the stopper.

10. An image forming apparatus comprising:

an image carrier;

a transferring device;

a fixing device; and the paper feeding device according to claim 1, wherein:

a sheet which is fed out from the paper feeding cassette is passed through a path between the image carrier and the transferring device, where an image of developing agent is transferred; and the image of the developing agent which is transferred is fixed by the fixing device.

11. A paper feeding device comprising:

a paper feeding device body;

a paper feeding cassette, which is contained in the paper feeding device body so as to be freely drawn out, including: a first member which is arranged at a forward side in a direction of drawing out the paper feeding cassette; and a second member which is arranged at a backward side in a drawing out direction and slidably connected to the first member; and a stopper for locking the paper feeding cassette when the paper feeding cassette is drawn out from the paper feeding device body, and a stopper releasing part which flexes when the stopper passes from a side of the stopper release part that is closer to a rear of the device body to a side of the stopper release part that is farther away from the rear of the device body, thereby releasing the stopper; wherein the first member is protruded from the paper feeding device body, and the second member is contained inside the paper feeding device body, in a state where the paper feeding cassette is extended and locked by means of the stopper;

wherein the stopper is formed at a rear of the paper feeding cassette.

12. The paper feeding device according to claim 11, further comprising a guide part for guiding the paper feeding cassette with respect to the paper feeding device body along a substantially rectilinear line and a stopper releasing part which is integrally formed with the guide part and flexes when the paper feeding cassette is further drawn out in the drawing out direction, thereby releasing the stopper;

wherein the stopper releasing part includes a projected part and thin-walled parts, the projected part projects from the releasing part at a position between the thin-walled parts, and the stopper locks the paper feeding cassette in a state where the stopper is ridden on the projected part.

13. The paper feeding device according to claim 12, wherein the projected part has a trapezoidal shape.

14. A paper feeding device comprising:

a paper feeding device body;

a paper feeding cassette, which is contained in the paper feeding device body so as to be freely drawn out, including: a first member which is arranged at a forward side in a direction of drawing out the paper feeding cassette; and a second member which is arranged at a backward side in the drawing out direction and slidably connected to the first member;

a stopper, which is provided with the second member, for locking the paper feeding cassette when the paper feeding cassette is drawn out from the paper feeding device body, and a stopper releasing part which flexes when the stopper passes from a side of the stopper release part that is closer to a rear of the device body to a side of the stopper release part that is farther away from the rear of the device body, thereby releasing the stopper; wherein the stopper is opposed to the paper feeding device body irrespective of whether the paper feeding cassette is extended or contracted;

wherein the stopper is formed at a rear of the paper feeding cassette.

15. The paper feeding device according to claim 14, further comprising a stopper releasing part which is integrally formed with the guide part and flexes when the paper feeding cassette is further drawn out in the drawing out direction, thereby releasing the stopper;

wherein the stopper releasing part includes a projected part and thin-walled parts, the projected part projects from the releasing part at a position between the thin-walled parts, and the stopper locks the paper feeding cassette in a state where the stopper is ridden on the projected part.

16. The paper feeding device according to claim 15, wherein the projected part has a trapezoidal shape.

* * * * *